US008834960B2

(12) United States Patent
Rudhardt et al.

(10) Patent No.: US 8,834,960 B2
(45) Date of Patent: Sep. 16, 2014

(54) PRODUCTION OF CONDUCTIVE SURFACE COATINGS USING A DISPERSION CONTAINING ELECTROSTATICALLY STABILISED SILVER NANOPARTICLES

(75) Inventors: Daniel Rudhardt, Köln (DE); Stefanie Eiden, Leverkusen (DE); Dirk Storch, Köln (DE); Elsa Karoline Schädlich, Leipzig (DE); Sven Sommerfeld, Schwelm (DE)

(73) Assignee: Bayer Intellectual Property GmbH, Monheim (DE)

( * ) Notice: Subject to any disclaimer, the term of this patent is extended or adjusted under 35 U.S.C. 154(b) by 226 days.

(21) Appl. No.: 13/044,129

(22) Filed: Mar. 9, 2011

(65) Prior Publication Data

US 2011/0223322 A1 Sep. 15, 2011

(30) Foreign Application Priority Data

Mar. 12, 2010 (EP) ..... 10002605

(51) Int. Cl.
*H01B 1/22* (2006.01)

(52) U.S. Cl.
CPC ..... *H01B 1/22* (2013.01); *Y10S 977/773* (2013.01); *Y10S 977/892* (2013.01)
USPC ..... 427/125; 252/520.3; 252/519.2; 977/773; 977/892

(58) Field of Classification Search
USPC ..... 427/125
See application file for complete search history.

(56) References Cited

U.S. PATENT DOCUMENTS

2009/0104437 A1 4/2009 Bortner et al.

FOREIGN PATENT DOCUMENTS

| | | | |
|---|---|---|---|
| EP | 1493780 | | 1/2005 |
| EP | 1916671 | | 4/2008 |
| EP | 1916671 | A2 * | 4/2008 |
| WO | WO-03/038002 | | 5/2003 |
| WO | WO-2005/079353 | | 9/2005 |
| WO | WO-2009/044389 | | 4/2009 |

OTHER PUBLICATIONS

Zetasizer Nano series technical note. Malvern Instruments. http://www.nbtc.cornell.edu/facilities/downloads/Zeta%20potential%20-%20An%20introduction%20in%2030%20minutes.pdf.*

Sun, Y., et al., *Triangular Nanoplates of Silver: Synthesis, Characterization, and Use of Sacrificial Templates for Generating Triangular Nanorings of Gold* (2003), pp. 695-699, Advanced Materials 15, No. 9, WILEY-VCH Verlag GmbH & Co, KGaA, Weinheim.

Ledwith, D., et al., *A Rapid, Straight-Forward Method for Controlling the Morphology of Stable Silver Nanoparticles* (2007), pp. 2459-2464, Journal of Materials Chemistry, 17, The Royal Society of Chemistry.

Lee, P., et al., *Adsorption and Surface-Enhanced Raman of Dyes on Silver and Gold Sols* (1982), pp. 3391-3395, vol. 86, No. 17, J. Phys. Chem. 86, American Chemical Society.

Henglein, A., et al., *Formation of Colloidal Silver Nanoparticles: Capping Action of Citrate* (1999), pp. 9533-9539, vol. 103, No. 44, J. Phys. Chem. B, American Chemical Society.

* cited by examiner

*Primary Examiner* — Dah-Wei D Yuan
*Assistant Examiner* — Kristen A Dagenais
(74) *Attorney, Agent, or Firm* — Novak Druce Connolly Bove + Quigg LLP

(57) ABSTRACT

The present invention relates to a process which comprises: providing a substrate having a surface; applying a dispersion to the surface, wherein the dispersion comprises at least one liquid dispersant, and electrostatically stabilized silver nanoparticles having a zeta potential of from −20 to −55 mV in the dispersant at a pH value of from 2 to 10; and heating one or both of the surface and the dispersion applied thereon to a temperature of from 50° C. below the boiling point of the dispersant to 150° C. above the boiling point of the dispersant, to form a conductive coating on the surface.

13 Claims, No Drawings

PRODUCTION OF CONDUCTIVE SURFACE COATINGS USING A DISPERSION CONTAINING ELECTROSTATICALLY STABILISED SILVER NANOPARTICLES

CROSS-REFERENCE TO RELATED APPLICATIONS

This application claims benefit to European Patent Application No. 10002605.3, filed Mar. 3, 2010, which is incorporated herein by reference in its entirety for all useful purposes.

BACKGROUND OF THE INVENTION

The present invention relates to a process for the production of conductive surface coatings using a dispersion containing electrostatically stabilised silver nanoparticles, to dispersions particularly suitable for this process, and to a process for their preparation.

In *Adv. Mater.,* 2003, 15, No. 9, 695-699, Xia et al. describe the preparation of stable aqueous dispersions of silver nanoparticles with poly(vinyl-pyrrolidone) (PVP) and sodium citrate as stabilisers. Xia thus obtains monodisperse dispersions containing silver nanoparticles having particle sizes of less than 10 nm and a narrow particle size distribution. The use of PVP as polymeric stabiliser results in steric stabilisation of the nanoparticles against aggregation. However, such steric polymeric dispersion stabilisers have the disadvantage that, in the resulting conductive coatings, because of the surface coating on the silver particles, they reduce the direct contact of the particles with one another and accordingly the conductivity of the coating. According to Xia it is not possible to obtain such stable monodisperse dispersions without using PVP.

EP 1 493 780 A1 describes the production of conductive surface coatings using a liquid conductive composition of a binder and silver particles, wherein the above-mentioned silver-containing silver particles can be silver oxide particles, silver carbonate particles or silver acetate particles, which in each case can have a size of from 10 nm to 10 μm. The binder is a polyvalent phenol compound or one of various resins, that is to say in any case a polymeric component. According to EP 1 493 780 A1, a conductive layer is obtained from this composition after application to a surface with heating, whereby heating is preferably to be carried out at temperatures of from 140° C. to 200° C. The conductive compositions described according to EP 1 493 780 A1 are dispersions in a dispersant selected from alcohols, such as methanol, ethanol and propanol, isophorones, terpineols, triethylene glycol monobutyl ethers and ethylene glycol monobutyl ether acetate. EP 1 493 780 A1 again mentions that the silver-containing particles in the dispersant are preferably to be protected against aggregation by addition of dispersion stabilisers such as hydroxypropylcellulose, polyvinylpyrrolidone and polyvinyl alcohol. These dispersion stabilisers are also polymeric components. The silver-containing particles are accordingly always sterically stabilised against aggregation in the dispersant by the above-mentioned dispersion stabilisers or the binder as dispersion stabiliser. However, such polymeric dispersion stabilisers with a steric action have the disadvantage—as already mentioned above—that, in the resulting conductive coatings, because of the surface coating on the silver particles, they reduce direct contact of the particles with one another and accordingly the conductivity of the coating. Although the organic solvents used as dispersants in 1 493 780 A1 accelerate the drying time, or reduce the drying temperatures, of the coatings applied therewith, so that even temperature-sensitive plastics surfaces can be coated therewith, such organic dispersants attack or can diffuse into the surface of plastics substrates, which can lead to swelling or damage of the substrate surface and of any underlying layers.

US 2009/104437 A1 discloses a process for coating surfaces with conductive coatings by means of electrostatic self-assembling. However, coating is carried out by means of an expensive, time-consuming multi-stage dipping process.

WO 03/038002 A1 discloses an inkjet printer composition obtained by reducing silver nitrate with boron hydride or citrate. However, the composition is not stable and is accordingly not suitable for the production of surface coatings.

WO 2009/044389 A2, WO 2005/079353 A2, JOURNAL OF MATERIALS CHEMISTRY, Vol. 17, 2007, pages 2459-2464, JOURNAL OF PHYSICAL CHEMISTRY, AMERICAN CHEMICAL SOCIETY, Vol. 86; No. 17, pages 3391-3395 and JOURNAL OF PHYSICAL CHEMISTRY B, Vol. 103, pages 9533-9539 also disclose silver nanoparticles stabilised with citrates and dispersions of those silver nanoparticles. However, there is no indication in any of those documents as to how conductive surface coatings can be produced by means of such dispersions in a manner that is simple and kind to the substrate.

Accordingly, there continued to be a need for a process for coating surfaces with conductive coatings using dispersions containing silver nanoparticles, in which process it is possible to use short drying and sintering times and/or low drying and sintering temperatures, so that even temperature-sensitive plastics surfaces can be coated, but in which damage to such surfaces by the dispersant used is not to be feared, wherein in this process too, premature aggregation and accordingly flocculation of the silver nanoparticles in the dispersions used is to be prevented by suitable stabilisation.

Starting from the prior art, the object was therefore to find such a process and dispersions suitable therefor. The above-mentioned, disadvantageous combination of improved stabilisation against aggregation with reduced conductivity of the surface coatings produced from the dispersions is thereby to be avoided. In preferred embodiments, the possibility of using this process for the coating of plastics surfaces with short drying and sintering times and/or low drying and sintering temperatures is not to be accompanied by the risk of damage to the surfaces.

EMBODIMENTS OF THE INVENTION

An embodiment of the present invention is a process which comprises

- providing a substrate having a surface
- applying a dispersion to the surface, wherein the dispersion comprises
  - a) at least one liquid dispersant, and
  - b) electrostatically stabilised silver nanoparticles having a zeta potential of from −20 to −55 mV in the dispersant at a pH value of from 2 to 10, and
- heating one or both of the surface and the dispersion applied thereon to a temperature of from 50° C. below the boiling point of the dispersant to 150° C. above the boiling point of the dispersant, to form a conductive coating on the surface.

Another embodiment of the present invention is the above process, wherein the surface and/or the dispersion positioned thereon is heated to at least a temperature in the range of from 20° C. below the boiling point of the dispersant to 100° C. above the boiling point of the dispersant of the dispersion at the prevailing pressure.

Another embodiment of the present invention is the above process, wherein the surface and/or the dispersion positioned thereon is heated to the temperature(s) for a period of from 10 seconds to 2 hours.

Another embodiment of the present invention is the above process, wherein the surface and/or the dispersion positioned thereon is heated to the specific temperature(s) for a period of from 30 seconds to 60 minutes.

Another embodiment of the present invention is the above process, wherein the silver nanoparticles of the dispersion have a zeta potential of from −25 to −50 mV in the above dispersant with electrostatic dispersion stabiliser at a pH value in the range of from 4 to 10.

Another embodiment of the present invention is the above process, wherein the dispersant is water or a mixture of water with compounds selected from the group consisting of alcohols having up to four carbon atoms, aldehydes having up to four carbon atoms, ketones having up to four carbon atoms, and mixtures thereof.

Another embodiment of the present invention is the above process, wherein the silver nanoparticles have been electrostatically stabilised by at least one electrostatic dispersion stabiliser selected from the group consisting of the carboxylic acids having up to five carbon atoms, salts of such a carboxylic acid, sulfates of such a carboxylic acid, and phosphates of such a carboxylic acid.

Another embodiment of the present invention is the above process, wherein the electrostatic dispersion stabiliser is at least one di- or tri-carboxylic acid having up to five carbon atoms or its salt.

Another embodiment of the present invention is the above process, wherein the electrostatic dispersion stabiliser is citric acid or citrate.

Another embodiment of the present invention is the above process, wherein the dispersion is an ink.

Another embodiment of the present invention is the above process, wherein the conductive surface coating has a specific conductivity of from $10^2$ to $3 \cdot 10^7$ S/m.

Another embodiment of the present invention is the above process, wherein the conductive surface coating has a dry film thickness of from 50 nm to 5 μm.

Another embodiment of the present invention is the above process, wherein the surface is the surface of a plastic substrate.

Another embodiment of the present invention is the above process, wherein the plastic substrate is a plastic film or a multilayer composite.

Yet another embodiment of the present invention is a dispersion comprising a) at least one liquid dispersant, b) electrostatically stabilised silver nanoparticles having a zeta potential in the range from −20 to −55 mV in the above dispersant at a pH value in the range from 2 to 10, and c) optionally further additives.

Yet another embodiment of the present invention is a process for the preparation of the above dispersion, which comprises reducing a silver salt to silver with a reducing agent in at least one dispersant in the presence of at least one electrostatic dispersion stabiliser.

DETAILED DESCRIPTION OF THE INVENTION

It has been found, surprisingly, that the above-mentioned object is achieved by a process for the production of conductive surface coatings in which a dispersion containing at least one liquid dispersant and electrostatically stabilised silver nanoparticles, the silver nanoparticles having a zeta potential in the range from −20 to −55 mV in the above dispersant at a pH value in the range from 2 to 10, is applied to a surface and the surface and/or the dispersion located thereon is brought to at least a temperature in the range from 50° C. below the boiling point of the dispersant to 150° C. above the boiling point of the dispersant of the dispersion.

The process according to the invention does not use steric, optionally polymeric dispersion stabilisers and it is possible when using plastics substrates to avoid high drying and sintering temperatures at which the substrate to be coated may be damaged.

Accordingly, the present invention provides a process for the production of conductive surface coatings, characterised in that a dispersion containing at least one liquid dispersant and electrostatically stabilised silver nanoparticles, the electrostatically stabilised silver nanoparticles having a zeta potential in the range from −20 to −55 mV in the above dispersant at a pH value in the range from 2 to 10, is applied to a surface and the surface and/or the dispersion located thereon is brought to at least a temperature in the range from 50° C. below the boiling point of the dispersant to 150° C. above the boiling point of the dispersant of the dispersion.

The liquid dispersant(s) is(are) preferably water or mixtures containing water and organic, preferably water-soluble organic solvents. The liquid dispersant(s) is(are) particularly preferably water or mixtures of water with alcohols, aldehydes and/or ketones, particularly preferably water or mixtures of water with mono- or poly-hydric alcohols having up to four carbon atoms, such as, for example, methanol, ethanol, n-propanol, isopropanol or ethylene glycol, aldehydes having up to four carbon atoms, such as, for example, formaldehyde, and/or ketones having up to four carbon atoms, such as, for example, acetone or methyl ethyl ketone. A most particularly preferred dispersant is water.

Within the context of the invention, silver nanoparticles are to be understood as being those having a $d_{50}$ value of less than 100 nm, preferably less than 80 nm, particularly preferably less than 60 nm, measured by means of dynamic light scattering. A ZetaPlus Zeta Potential Analyzer from Brookhaven Instrument Corporation, for example, is suitable for measurement by means of dynamic light scattering.

A dispersion within the scope of the present invention denotes a liquid comprising those silver nanoparticles. Preferably, the silver nanoparticles are present in the dispersion in an amount of from 0.1 to 65 wt. %, particularly preferably from 1 to 60 wt. %, most particularly preferably from 5 to 50 wt. %, based on the total weight of the dispersion.

For the electrostatic stabilisation of the silver nanoparticles, at least one electrostatic dispersion stabiliser is added during the preparation of the dispersions. An electrostatic dispersion stabiliser within the scope of the invention is to be understood as being one by whose presence the silver nanoparticles are provided with repelling forces and, on the basis of those repelling forces, no longer have a tendency towards aggregation. Consequently, due to the presence and action of the electrostatic dispersion stabiliser, repelling electrostatic forces prevail between the silver nanoparticles, which forces counteract the van-der-Waals forces whose action brings about aggregation of the silver nanoparticles.

The electrostatic dispersion stabiliser is present in the dispersions according to the invention preferably in an amount of from 0.5 to 5 wt. %, particularly preferably in an amount of from 1 to 3 wt. %, based on the weight of the silver of the silver nanoparticles in the dispersion.

The electrostatic dispersion stabiliser(s) is(are) preferably carboxylic acids having up to five carbon atoms, salts of such carboxylic acids or sulfates or phosphates. Preferred electrostatic dispersion stabilisers are di- or tri-carboxylic acids having up to five carbon atoms or their salts. When di- or tri-carboxylic acids are used, they can be employed together with amines in order to adjust the pH value. Suitable amines are monoalkyl-, diallyl- or dialkanol-amines, such as, for example, diethanolamine. The salts can preferably be the alkali or ammonium salts, preferably the lithium, sodium, potassium or ammonium salts, such as, for example, tetramethyl-, tetraethyl- or tetrapropyl-ammonium salts. Particularly preferred electrostatic dispersion stabilisers are citric acid or citrates, such as, for example, lithium, sodium, potassium or tetramethylammonium citrate. Citrate, such as, for example, lithium, sodium, potassium or tetramethylammonium citrate, is most particularly preferably used as the electrostatic dispersion stabiliser. The electrostatic dispersion stabilisers in salt form are present in the aqueous dispersion dissociated as far as possible into their ions, the respective anions effecting electrostatic stabilisation. Any excess of the electrostatic dispersion stabiliser(s) that is present is preferably removed before the dispersion is applied to the surface. Known purification processes, such as, for example, diafiltration, reverse osmosis and membrane filtration, are suitable for that purpose.

The above-mentioned electrostatic dispersion stabilisers are advantageous over polymeric dispersion stabilisers, such as, for example, PVP, which effect stabilisation purely sterically by surface coating, because they promote the development of the mentioned zeta potential of the silver nanoparticles in the dispersion but at the same time result in no, or only negligible, steric hindrance of the silver nanoparticles in the conductive surface coating subsequently obtained from the dispersion.

Because the silver nanoparticles have a zeta potential in the range from −20 to −55 mV in the above dispersant at a pH value in the range from 2 to 10, stabilisation of the silver nanoparticles in the dispersion against aggregation is for the first time achieved not by steric hindrance but as a result of the fact that the silver nanoparticles, on the basis of repelling forces, no longer have a tendency towards aggregation. Repelling electrostatic forces consequently prevail between the silver nanoparticles, which forces counteract the van-der-Waals forces whose action brings about aggregation of the silver nanoparticles.

Preferably, the silver nanoparticles of the dispersion have a zeta potential in the range from −25 to −50 mV in the above dispersant with electrostatic dispersion stabiliser at a pH value in the range from 4 to 10, most particularly preferably a zeta potential in the range from −28 to −45 mV in the above dispersant with electrostatic dispersion stabiliser at a pH value in the range from 4.5 to 10.0.

Determination of the pH value is carried out by means of a pH electrode, preferably in the form of a glass electrode as a single-rod measuring cell, at 20° C.

Measurement of the zeta potential is carried out by means of electrophoresis. Various devices known to the person skilled in the art are suitable for that purpose, such as, for example, those of the ZetaPlus or ZetaPALS series from Brookhaven Instruments Corporation. Measurement of the electrophoretic mobility of particles is carried out by means of electrophoretic light scattering (ELS). The light scattered by the particles moved in the electric field undergoes a frequency change owing to the Doppler effect, which change is used to determine the velocity of migration. In order to measure very small potentials or for measurements in non-polar media or at high salt concentrations, the so-called phase analysis light scattering (PALS) technique can also be applied (e.g. using ZetaPALS devices).

Because the above-mentioned zeta potential is dependent on the liquid dispersant surrounding the silver nanoparticles, in particular on the pH value of the dispersant, and because such a zeta potential is greatly reduced outside such a dispersion, the above-mentioned repelling electrostatic forces no longer continue to exist when the dispersant is removed, so that, in spite of the outstanding stabilisation against aggregation of the silver nanoparticles in the dispersion, the subsequent conductivity of a conductive surface coating produced from the dispersion is not impaired.

Moreover, stabilisation by means of electrostatic repulsion has the effect that conductive surface coatings can be produced from the dispersion in a simplified manner. By means of the present invention it is also possible for the first time to obtain such surface coatings more rapidly and with a lower thermal load on the coated surface.

Preferably, the surface and/or the dispersion located thereon is brought to at least a temperature in the range from 20° C. below the boiling point of the dispersant to 100° C. above the boiling point of the dispersant, particularly preferably to at least a temperature in the range from 10° C. below the boiling point of the dispersant to 60° C. above the boiling point of the dispersant at the prevailing pressure. Heating serves both to dry the applied coating and to sinter the silver nanoparticles. The period of heating is preferably from 10 seconds to 2 hours, particularly preferably from 30 seconds to 60 minutes. The higher the temperature(s) to which the surface and/or the dispersion located thereon is heated, the shorter the heating period required to achieve the desired specific conductivity.

The boiling point of the dispersion is determined at standard atmospheric pressure (1013 hPa). The boiling point of the dispersion can be altered by operating at a different pressure.

In the case of surfaces to be coated on plastics substrates, the surface and/or the dispersion located thereon is heated to at least a temperature below the Vicat softening temperature of the plastics substrate. Preferably, temperatures that are at least 5° C., particularly preferably at least 10° C., most particularly preferably at least 15° C. below the Vicat softening temperature of the plastics substrate are chosen.

The Vicat softening temperature B/50 of a plastics material is the Vicat softening temperature B/50 according to ISO 306 (50 N; 50° C./h).

Unless indicated otherwise, the temperatures mentioned hereinabove and hereinbelow refer to temperatures at ambient pressure (1013 hPa). Within the context of the invention, however, the heating can also be carried out at reduced ambient pressure and correspondingly reduced temperatures in order to achieve the same result.

The use of citrate as the electrostatic dispersion stabiliser is particularly advantageous because it melts at temperatures of only 153° C. or decomposes at temperatures above 175° C.

In order further to improve the conductive surface coatings obtained from the dispersions it can be desirable to remove not only the dispersant but also the electrostatic dispersion stabiliser from the coatings as far as possible, because the dispersion stabiliser has reduced conductivity as compared with the silver nanoparticles and accordingly may slightly impair the specific conductivity of the resulting coating. On account of the above-mentioned properties of citrate, that can be achieved in a simple manner by heating.

In the case of the dispersions according to the invention it is possible in particular to dispense with the use of polymeric substances as stabilisers, which slow down the drying and/or sintering of the surface coating obtained from the dispersion or even require an elevated temperature in order for drying and/or sintering and accordingly conductivity of the surface coating by sintering of the silver particles to occur.

The surface to be coated is preferably the surface of a substrate. The substrates can be made of any desired materials, which may be the same or different, and can have any desired shape. The substrates can be, for example, glass, metal, ceramics or plastics substrates or substrates in which such components have been processed together. The process according to the invention exhibits particular advantages in the coating of plastics-containing substrate surfaces because, owing to the possible low drying and sintering temperatures and short drying and sintering times, they are exposed to only a moderate thermal load and undesirable deformation and/or other damage can thus be avoided. The surface to be coated is particularly preferably the surface of a plastics substrate, preferably of a plastics film or sheet or of a multilayer composite film or sheet.

The conductive surface coating produced by the process according to the invention preferably exhibits a specific conductivity of from $10^2$ to $3 \cdot 10^7$ S/m. The specific conductivity is determined as the reciprocal value of the specific resistance. The specific resistance is calculated by determining the ohmic resistance and the geometry of strip conductors. By means of the process according to the invention it is possible to achieve high specific conductivities of more than $10^5$ S/m, preferably more than $10^6$ S/m. However, depending on the application, it may be entirely sufficient to produce surface coatings having lower specific conductivities and thereby apply lower temperatures and shorter times for drying and/or sintering than would be necessary to achieve a higher specific conductivity.

The conductive surface coating produced by the process according to the invention preferably exhibits a dry film thickness of from 50 nm to 5 μm, particularly preferably from 100 nm to 2 μm. The dry film thickness is determined, for example, by means of profilometry. A MicroProf® from Fries Research & Technology (FRT) GmbH, for example, is suitable for that purpose.

In preferred embodiments of the present invention, the dispersion is an ink, preferably a printing ink. Such printing inks are preferably those which are suitable for printing by means of inkjet printing, gravure printing, flexographic printing, rotary printing, aerosol jetting, spin coating, knife application or roller application. To that end, appropriate additives, such as, for example, binders, thickeners, flow improvers, colouring pigments, film formers, adhesion promoters and/or antifoams, can be added to the dispersion. In preferred embodiments, the dispersion according to the invention can contain up to 2 wt. %, preferably up to 1 wt. %, of such additives, based on the total weight of the dispersion. Furthermore, cosolvents can also be added to the dispersion. In preferred embodiments, the dispersion according to the invention can contain up to 20 wt. %, preferably up to 15 wt. %, of such cosolvents, based on the total weight of the dispersion.

In a preferred embodiment of the invention, the printing inks have a viscosity of from 5 to 25 mPas (measured at a shear rate of 1/s) for printing by means of inkjet printing and a viscosity of from 50 to 150 mPas (measured at a shear rate of 10/s) for printing by means of flexographic printing. The viscosities can be determined at the appropriate shear rate using a rheometer from Physica. That viscosity is preferably achieved by addition of the above-mentioned additives.

There are suitable for use in the process according to the invention, and accordingly likewise provided by the present invention, preferably dispersions containing at least one liquid dispersant, silver nanoparticles and at least one electrostatic dispersion stabiliser, optionally further additives, characterised in that the silver nanoparticles have a zeta potential in the range from −20 to −55 mV in the above dispersant with electrostatic dispersion stabiliser at a pH value in the range from 2 to 10, but which are free of polymeric, steric dispersion stabilisers.

Most particularly preferably, they are dispersions consisting of at least one liquid dispersant, silver nanoparticles and at least one electrostatic dispersion stabiliser, optionally further additives, characterised in that the silver nanoparticles have a zeta potential in the range from −20 to −55 mV in the above dispersant with electrostatic dispersion stabiliser at a pH value in the range from 2 to 10, but which are free of polymeric, steric dispersion stabilisers.

Additives are to be understood as being only such additional components which are used beforehand to produce a printing ink but do not comprise polymeric, steric dispersion stabilisers.

In a preferred embodiment of the present invention the dispersion contains less than 2 wt. %, preferably less than 1 wt. % based on the total weight of the dispersion of steric dispersion stabilisers, in particular of polymeric, steric dispersion stabilisers. In a preferred embodiment of the present invention the dispersion contains no steric dispersion stabilisers, in particular no polymeric, steric dispersion stabilizers. Such steric dispersion stabilisers are in particular compounds selected from the group of alkoxylates, alkylolamides, esters, amine oxides, alkyl polyglucosides, alkylphenols, arylalkylphenols. Such polymeric steric dispersion stabilisers are in particular compounds selected from the group of water-soluble homopolymers, water-soluble random copolymers, water-soluble block copolymers, water-soluble graft polymers, in particular polyvinyl alcohols, copolymers of polyvinyl alcohols and polyvinyl acetates, polyvinyl pyrrolidones, cellulose, starch, gelatine, gelatine derivatives, polymers of amino acids, polylysine, polyaspartic acid, polyacrylates, polyethylene sulfonates, polystyrene sulfonates, polymethacrylates, condensation products of aromatic sulfonic acids and formaldehyde, naphthalene sulfonates, lignin sulfonates, copolymers of acrylic monomers, polyethylenimines, polyvinylamines, polyallylamines, poly(2-vinylpyridines), block copolyethers, block copolyethers with polystyrene blocks and/or polydiallyl dimethylammonium chloride.

The preferred ranges mentioned hereinbefore for the process according to the invention apply equally to the dispersions according to the invention.

The dispersions according to the invention can be prepared by reduction of a silver salt in a dispersant in the presence of an electrostatic dispersion stabiliser.

Accordingly, the present invention further provides a process characterised in that a silver salt is reduced to silver with a reducing agent in at least one dispersant in the presence of at least one electrostatic dispersion stabiliser.

Suitable reducing agents for use in the above-mentioned process according to the invention are preferably thioureas, hydroxyacetone, boron hydrides, iron ammonium citrate, hydroquinone, ascorbic acid, dithionites, hydroxymethanesulfinic acid, disulfites, formamidinesulfinic acid, sulfurous acid, hydrazine, hydroxylamine, ethylenediamine, tetramethylethylenediamine and/or hydroxylamine sulfates.

Particularly preferred reducing agents are boron hydrides. A most particularly preferred reducing agent is sodium borohydride.

Suitable silver salts are, for example and preferably, silver nitrate, silver acetate, silver citrate. Silver nitrate is particularly preferred.

The preferred ranges mentioned hereinbefore for the process according to the invention for the production of conductive surface coatings apply equally to the process according to the invention for the preparation of dispersions.

The electrostatic dispersion stabiliser(s) is(are) preferably used in a molar excess relative to the silver salt, and corresponding excesses are removed before the dispersions are used to coat surfaces. Known purification processes are suitable for that purpose, such as, for example, diafiltration, reverse osmosis and membrane filtration.

In a preferred embodiment of the process according to the invention for the preparation of dispersions, the reduction product obtained after reduction of the silver salt is accordingly subjected to purification. Purification processes which can be used for that purpose are, for example, the processes generally known to the person skilled in the art, such as, for example, diafiltration, reverse osmosis and membrane filtration.

The invention is explained in greater detail hereinbelow by means of examples and figures, but without being limited thereto.

All the references described above are incorporated by reference in their entireties for all useful purposes.

While there is shown and described certain specific structures embodying the invention, it will be manifest to those skilled in the art that various modifications and rearrangements of the parts may be made without departing from the spirit and scope of the underlying inventive concept and that the same is not limited to the particular forms herein shown and described.

EXAMPLES

Measurement of the Specific Conductivities

In order to measure the specific conductivities mentioned hereinbelow, four lines of equal length and different widths were printed:

1st line: length 9 cm, width 3 mm
2nd line: length 9 cm, width 2.25 mm
3rd line: length 9 cm, width 2 mm
4th line: length 9 cm, width 1 mm After drying and sintering for 10 minutes at a constant temperature of 140° C. in a drying oven, the ohmic resistance was determined by means of a multimeter (Benning MM6). Measurement was carried out at the outer points of each of the lines, that is to say at the two ends of the lines, which corresponded to a spacing of 9 cm.

The layer thickness was then determined using a Veeco Dektak 150 surface profiler. Two measurements were carried out per line—one measurement one third of the way along the length and another two thirds of the way along the length of the line—and the mean value was calculated. If the layer thickness was too inhomogeneous, an additional measurement was carried out in the middle of the line. The specific conductivity κ was calculated from the resulting values as follows:

$$\kappa = 1/(((\text{width of the line} \cdot \text{layer thickness in mm}) \cdot \text{measured resistance in ohms})/\text{length of the line in m})$$

The resulting values are given in $S/m \cdot 10^6$.

Example 1

Preparation of a Dispersion According to the Invention 1 liter of distilled water was placed in a flask having a capacity of 2 liters. There were then added, with stirring, 100 ml of a 0.7 wt. % trisodium citrate solution and, thereafter, 200 ml of a 0.2 wt. % sodium borohydride solution. A 0.045 molar silver nitrate solution was slowly metered into the resulting mixture, with stirring, over a period of one hour with a volume flow rate of 0.2 l/h. The dispersion according to the invention formed thereby and was subsequently purified by diafiltration and concentrated to a solids content of 20 wt. %, based on the total weight of the dispersion. The content of citrate, based on the weight of silver in the dispersion, was 1.76 wt. %.

The resulting dispersion was subsequently diluted in a ratio of 1/200 with distilled water to a solids content of 0.05 wt. %, based on the total weight of the sample, and the pH value of the resulting dilute dispersion was adjusted to different values according to the following table by addition of concentrated sodium hydroxide solution or concentrated hydrochloric acid.

The pH value was measured using a glass electrode as a single-rod measuring cell at 20° C.

TABLE 1

| Sample [#] | pH [—] |
|---|---|
| 1 | 10 |
| 2 | 8.8 |
| 3 | 7.5 |
| 4 | 6.3 |
| 5 | 4.9 |
| 6 | 3.8 |
| 7 | 2.4 |

The zeta potential of samples 1 to 7 so obtained was then determined according to Example 2.

Example 2

Measurement of the Zeta Potential of the Dispersions According to Example 1

The following zeta potentials of the dispersions from Example 1 according to the following table were measured. All measurements of the samples were carried out three times and a resulting standard deviation of ±0.5 was determined. Measurement of the zeta potential is carried out using Brookhaven Instruments Corporation 90 Plus, ZetaPlus Particle Sizing Software Version 3.59, measured in a dispersion having a solids content of 0.05 wt. %, based on the total weight of the sample to be measured.

TABLE 2

| Sample [#] | pH [—] | Zeta potential [mV] |
|---|---|---|
| 1 | 10 | −43.9 ± 0.5 |
| 2 | 8.8 | −34.2 ± 0.5 |
| 3 | 7.5 | −38.3 ± 0.5 |
| 4 | 6.3 | −29.1 ± 0.5 |
| 5 | 4.9 | −28.6 ± 0.5 |
| 6 | 3.8 | −23.3 ± 0.5 |
| 7 | 2.4 | −23.7 ± 0.5 |

It will be seen that the electrostatically stabilised silver nanoparticles of the dispersions according to the invention have a zeta potential in the range from −23 mV to −44 mV.

Example 3

Production of a Conductive Surface Coating Using the Dispersion According to Example 1

A 2 mm wide line of the dispersion according to Example 1 (sample 3) was applied to a polycarbonate film (Bayer MaterialScience AG, Makrolon® DE1-1) and dried and sintered for 10 minutes in an oven at 140° C. and ambient pressure (1013 hPa). The surface coating was then already dry, so that wiping did not visibly remove any of the surface coating.

The specific conductivity was then determined directly by means of four-point resistance determination, the spacing between the contact points being 1 cm in each case. The calculated specific conductivity was $1.25 \cdot 10^6$ S/m.

Comparison Example

Dispersion and Surface Coating not According to the Invention

For comparison, a dispersion containing sterically stabilised silver nanoparticles was prepared. To that end, a mixture of a 0.054 molar sodium hydroxide solution and the dispersing aid Disperbyk® 190 (manufacturer BYK Chemie) (1 g/l) in a volume ratio of 1:1 was added to a 0.054 molar silver nitrate solution, and stirring was carried out for 10 minutes. An aqueous 4.6 molar aqueous formaldehyde solution was added to that reaction mixture, with stirring, so that the ratio $Ag^+$ to reducing agent is 1:10. This mixture was heated to 60° C., maintained at that temperature for 30 minutes and then cooled. The particles were separated from the unreacted starting materials in a first step by means of diafiltration, and then the sol was concentrated, for which a 30,000 dalton membrane was used. A colloidally stable sol having a solids content of up to 10 wt. % (silver particles and dispersing aid) formed. According to elemental analysis, the content of Disperbyk® 190 after the membrane filtration was 6 wt. %, based on the silver content. Analysis by means of laser correlation spectroscopy gave an effective particle diameter of 78 nm.

In the resulting dispersion, the silver particles are stabilised by the polymeric steric stabilisers PVP K 15 and Disperbyk® 190.

In the same manner as described in Example 3, a surface coating of the dispersion was applied to a polycarbonate film. The specific conductivity, determined analogously to Example 3, could only be determined after a drying and sintering time of one hour at 140° C. and ambient pressure (1013 hPa).

After that drying and sintering time of one hour, the specific conductivity was approximately 1 S/m. A higher specific conductivity of $10^6$ S/m could only be determined after a total drying and sintering time of four hours.

The surface coating produced with the dispersions according to the invention accordingly has a markedly higher conductivity at a lower drying and sintering temperature even after a markedly shorter drying and sintering time. The surface coating produced using the dispersion containing sterically stabilised silver nanoparticles required a considerably longer drying and sintering time to achieve a comparable specific conductivity.

The invention claimed is:

1. A process which comprises providing a substrate having a surface applying a dispersion to the surface, wherein the dispersion comprises a) at least one liquid dispersant, wherein the liquid dispersant is water or a mixture containing water and a water soluble organic solvent, and b) electrostatically stabilized silver nanoparticles having a zeta potential of from −20 to −55 mV in the dispersant at a pH value of from 2 to 10, wherein the silver nanoparticles have been electrostatically stabilized by at least one electrostatic dispersion stabilizer selected from the group consisting of di- or tri-carboxylic acids having up to five carbon atoms, and their salts, and heating one or both of the surface and the dispersion applied thereon to a temperature of from 50° C. below the boiling point of the dispersant to 150° C. above the boiling point of the dispersant, to form a conductive coating on the surface.

2. The process according to claim 1, wherein the surface and/or the dispersion positioned thereon is heated to at least a temperature in the range of from 20° C. below the boiling point of the dispersant to 100° C. above the boiling point of the dispersant at the prevailing pressure.

3. The process according to claim 1, wherein the surface and/or the dispersion positioned thereon is heated to the specific temperature(s) for a period of from 10 seconds to 2 hours.

4. The process according to claim 1, wherein the surface and/or the dispersion positioned thereon is heated to the specific temperature(s) for a period of from 30 seconds to 60 minutes.

5. The process according to claim 1, wherein the silver nanoparticles of the dispersion have a zeta potential of from −25 to −50 mV in the above dispersant with electrostatic dispersion stabiliser at a pH value in the range of from 4 to 10.

6. The process according to claim 1, wherein the dispersant is water or a mixture of water with compounds selected from the group consisting of alcohols having up to four carbon atoms, aldehydes having up to four carbon atoms, ketones having up to four carbon atoms, and mixtures thereof.

7. The process according to claim 1, wherein the electrostatic dispersion stabiliser is citric acid or citrate.

8. The process according to claim 1, wherein the dispersion is an ink.

9. The process according to claim 1, wherein the conductive surface coating has a specific conductivity of from $10^2$ to $3 \cdot 10^7$ S/m.

10. The process according to claim 1, wherein the conductive surface coating has a dry film thickness of from 50 nm to 5 μm.

11. The process according to claim 1, wherein the surface is the surface of a plastic substrate.

12. The process according to claim 11, wherein the plastic substrate is a plastic film or a multilayer composite.

13. The process according to claim 1, wherein the electrostatic dispersion stabiliser is present in amount of from 1 to 3 wt. %, based on the weight of the silver of the silver nanoparticles in the dispersion.

* * * * *